United States Patent [19]

Robinson et al.

[11] Patent Number: 4,512,134

[45] Date of Patent: Apr. 23, 1985

[54] UNIVERSAL TYPE PACKING HEAD

[75] Inventors: Mary K. Robinson, Akron; Timothy F. Probst, North Canton, both of Ohio

[73] Assignee: Figgie International, Willoughby, Ohio

[21] Appl. No.: 440,365

[22] Filed: Nov. 9, 1982

[51] Int. Cl.[3] ..... B65B 21/16

[52] U.S. Cl. ..... 53/248; 53/262

[58] Field of Search ..... 53/247, 248, 539, 246, 53/262

[56] References Cited

U.S. PATENT DOCUMENTS

| | | | |
|---|---|---|---|
| 3,052,071 | 9/1962 | Copping | 53/539 X |
| 3,057,136 | 10/1962 | Walter | 53/248 X |
| 4,078,361 | 3/1978 | Hartness et al. | 53/248 X |
| 4,175,364 | 11/1979 | Becker et al. | 53/248 X |
| 4,325,208 | 4/1982 | Barker | 53/248 X |

*Primary Examiner*—Horace M. Culver

*Attorney, Agent, or Firm*—Oldham, Oldham, Hudak & Weber Co.

[57] ABSTRACT

A universal type packing or grid head for use in article packing apparatus wherein a plurality of articles are fed to the head for assembly into a group of articles for filling a case. The grouped articles are ultimately deposited into a packing case for transport. The packing head is readily adjustable as to size and quantity of articles formed into a group.

9 Claims, 6 Drawing Figures

UNIVERSAL TYPE PACKING HEAD

BACKGROUND OF THE INVENTION

This invention relates to the type of a packing or grid head that was shown in U.S. Pat. No. 3,052,071 where articles are fed to the grid head for assembly into a group of articles which are dropped as a group into a case positioned below the grid head for filling the carrier case. Other very similar grid heads are shown in U.S. Pat. No. 3,922,836, 4,175,364 and 4,325,208. All of these grid heads are made so that they will process one size of an article and with a predetermined number of the articles to be formed into a group for deposit into a carrier case. These grid structures have worked quite well commercially in large numbers heretofore but demands do exist for some article case packer apparatus that would not require an entire grid head to be replaced or changed with variation in the number or size of the articles being processed for deposit into a carrier case.

DISCLOSURE OF INVENTION

A grid head for a case packer apparatus including a carrier frame, a shifting frame positioned on the carrier frame for movement laterally thereof; a plurality of skid blade mounting members are slidably engaged with blade bars of the shifting frame and are secureable in positions thereon.

Other members provided include a pair of mounting bars extending across the carrier frame adjacent opposite ends thereof and grid partition plate mounting brackets are operatively secured to opposed faces of the mounting bars and wherein the mounting brackets are positioned in opposed pairs on the mounting bars to engage a grid partition plate that slides down into engagement with the pair of such mounting brackets. The mounting brackets are readily removable as units to facilitate change in the article size processed and grouping actions obtained in the grid head.

BRIEF DESCRIPTION OF DRAWINGS

The general object of the invention is to provide an improved grid head for case packers wherein the number of articles to be grouped and/or the size of the articles to be processed or the grouping arrangement can be readily varied in the grid head by change in position and/or removal of a few parts in the grid head and with the majority of the components of grid head remaining of a fixed construction.

Another object of the invention is to position the grid partition plates on a carrier frame for a case packer apparatus whereby they can be readily removed and replaced to adapt a grid head to process and receive varied number and sizes of articles to be grouped and dropped.

Yet another object of the invention is to reduce the inventory of apparatus required in article packaging operations and especially to reduce the inventory of grid heads normally needed for use in a case packer apparatus, and to require change of only a minimum of parts in a grid head to alter its article collection and deposit pattern.

Yet another object of the invention is to position skid blades in a grid head for convenient, lateral adjustment to aid in adapting the grid head for processing different sized articles.

The foregoing and other objects of the invention as well as advantages of the invention will be made more apparent as the specification proceeds.

Figure 6:
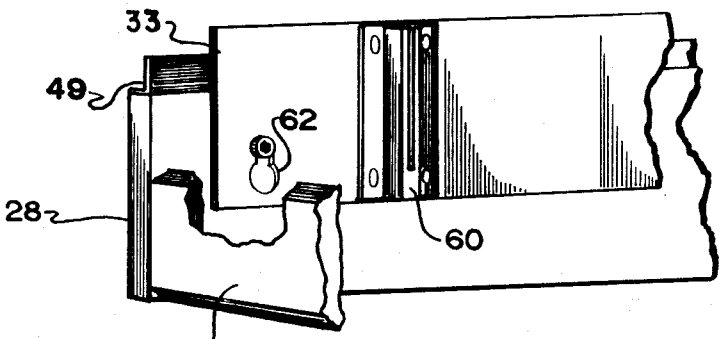
Figure 1:
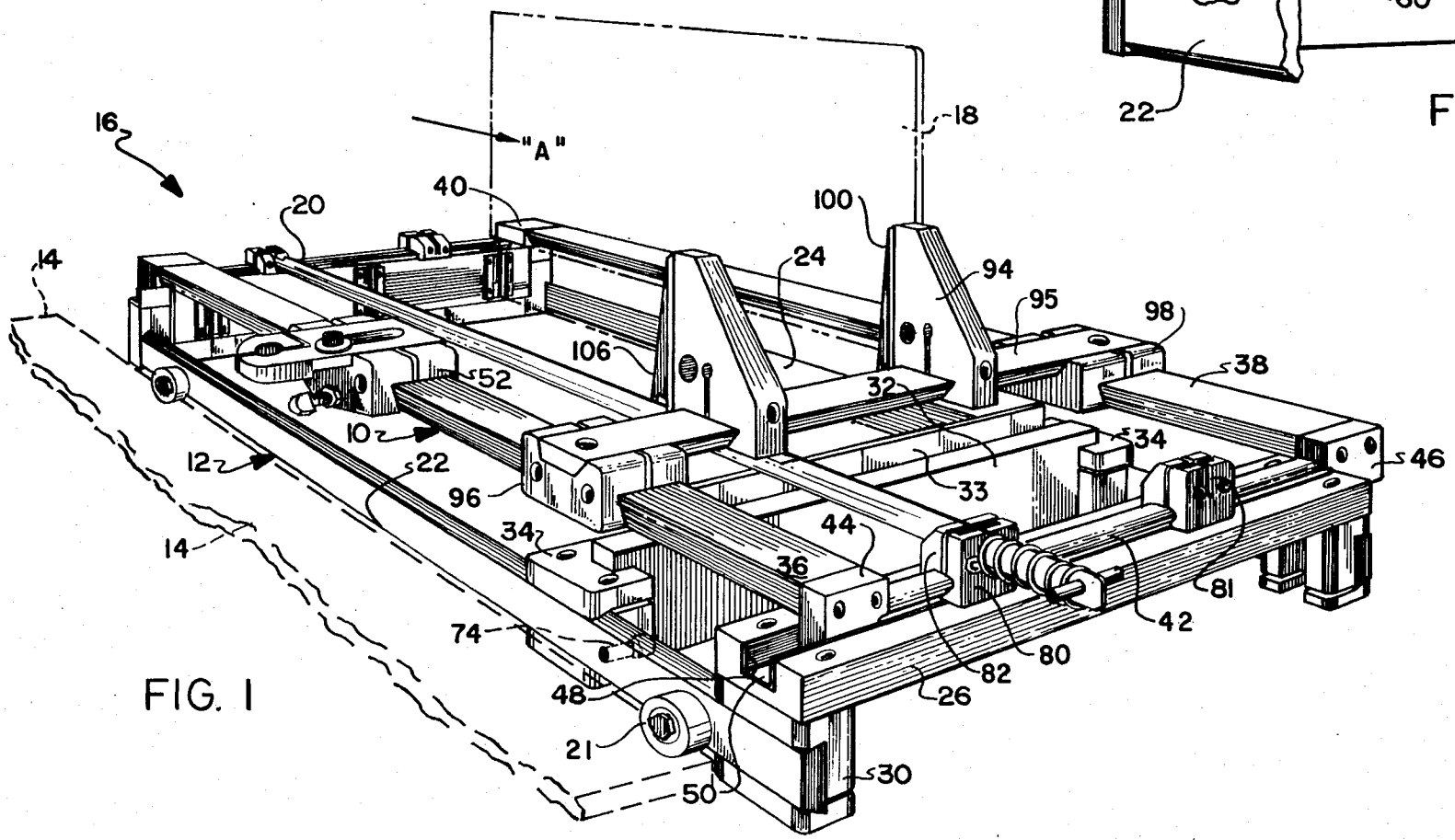
Figure 2:
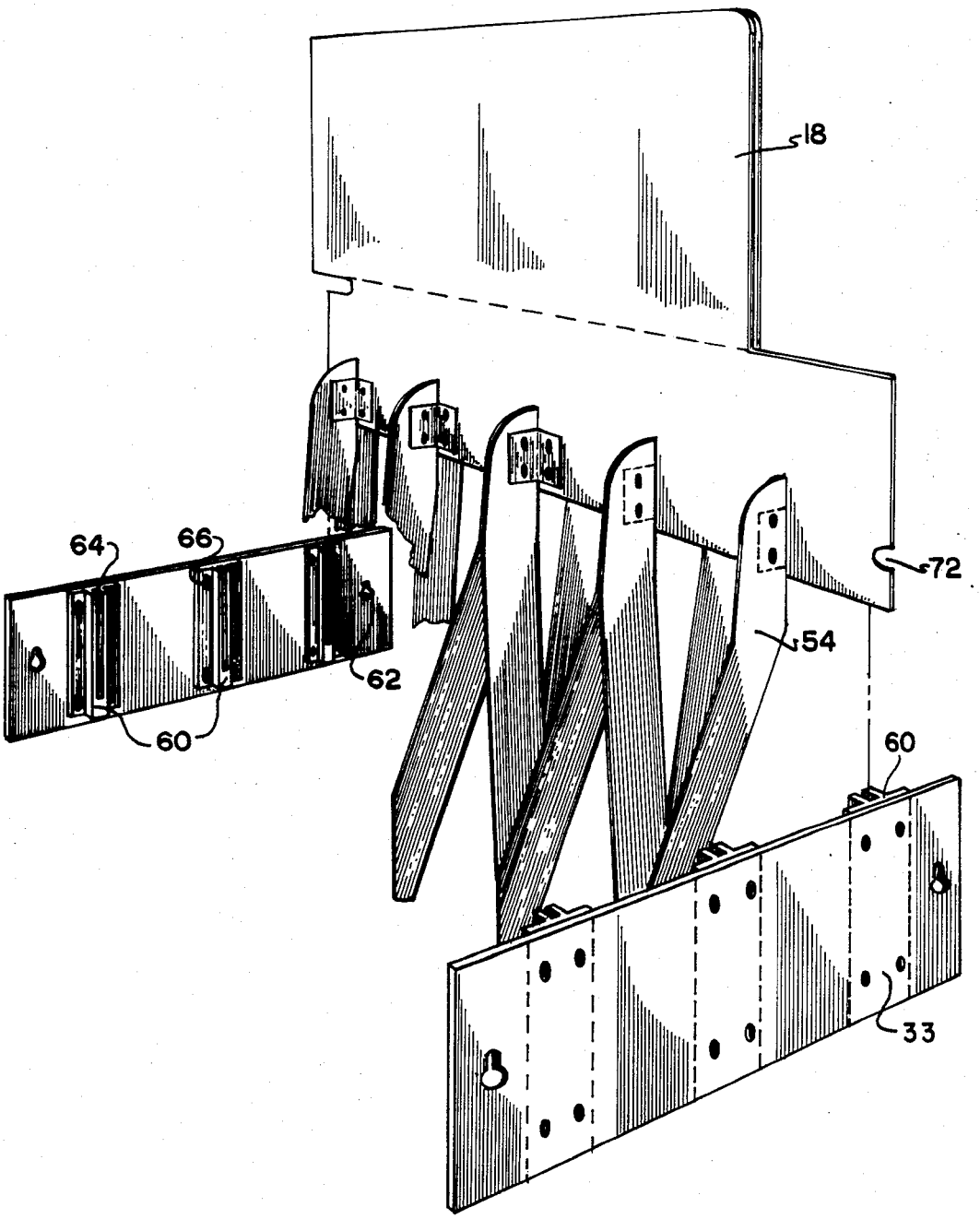
Figure 5:
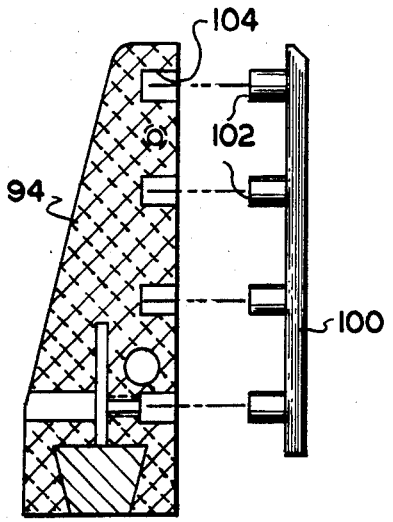
Figure 4:
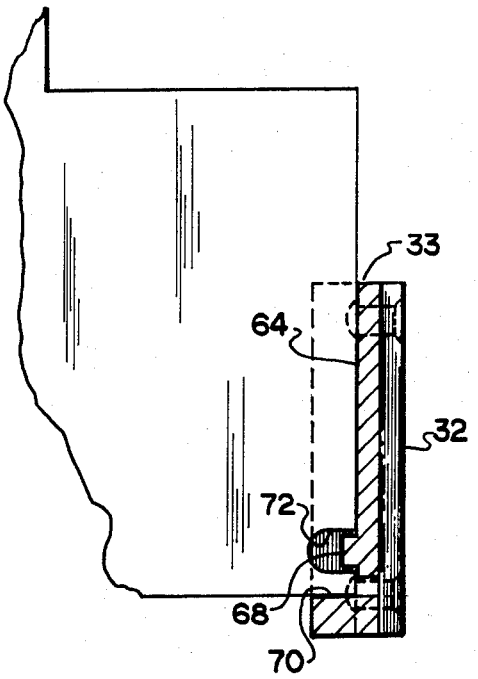
Figure 3:
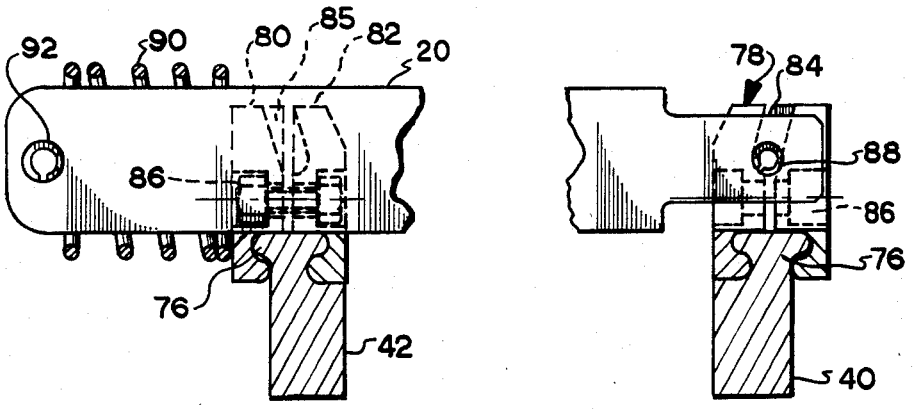

For a better understanding of the invention, reference now is made to the accompanied drawings wherein:

FIG. 1 is a perspective of a packing head embodying the present invention;

FIG. 2 is a partial exploded view of a grid partition plate and associated means and particularly the mounting bars or means therefore in the packing head;

FIG. 3 is a fragmentary vertical section, partly broken away, of the skid blade mounting members in the packing head;

FIG. 4 is a fragmentary vertical section through one of the grid partition plate mounting bars and associated means;

FIG. 5 is an exploded vertical section through an article stop block and its face pad; and FIG. 6 is a fragmentary perspective of an upstream corner of the carrier frame.

When referring to corresponding numbers shown in the drawings and referred to in the specification, corresponding numerals are used to facilitate comparison therebetween.

BEST MODE FOR CARRYING OUT THE INVENTION

FIG. 1 shows the novel shifting frame of the invention in which frame is indicated as a whole by the numeral 10. This shifting frame 10 is positioned on a carrier or stationary frame indicated as a whole by the numeral 12 and such carrier frame in turn is a part of a case packer apparatus particularly of the type shown in U.S. Pat. No. 3,052,071, a portion of a frame 14 of such case packer being shown. This case packer is adapted to provide a plurality of streams of abutted articles that are fed into the packing head for arrangement into groups of articles for filling a case. The articles next are dropped down into a case positioned below this shifting frame 10 and the case is processed in the case packer apparatus to be removed promptly from association with the packing head.

The case packer apparatus functions so that additional empty cases are fed into operative association with the packing head and associated means and the articles to be packed are moved into the packing head in the direction of arrow A, as shown. These articles move through paths formed by a plurality of grid partition plates 18 a plurality of which are positioned in parallel relationship to each other on the carrier frame 12 as later described herein, with only a portion of one of these plates being shown in FIG. 1. The articles being processed move into and along the packing head by means of skid blades 20 only one of which is shown in FIG. 1 but with one skid blade being provided underneath each article receiving and transmitting channel formed in the packing head.

To form the stationary frame 12, a pair of side bars 22 and 24 are secured to and extend between a pair of cross or end bar 26 and 28, the cross bars 26 has a pair of dependent blocks 30 secured to and depending from its end portions for attachment of the side bars thereto to form part of the frame unit. The upstream end bar 28, FIG. 6, is suitably attached to the side bars 22 and 24. Additionally, one mounting bar 32 extends across between the side bars 22 and 24 and is operatively secure thereto as by end wedge blocks 34 suitably engaged with each end of the mounting bar 32 and which slidably engaged the side bars in a conventional manner. The end bar 28 and the mounting bar 32 serve to position, operatively, grid clamps as hereinafter described so such bars can be termed grid clamp mounting means.

The shifting frame 10 includes a pair of opposed contoured side bars 36 and 38 the ends of which are attached to cross bars 40 and 42. These cross or blade bars 40 and 42 have reduced height center areas and higher ends that are attached to the side bars 36 and 38.

FIGS. 1 and 6 show that the upper surface of the bars 26 and 28 have a channel 48 and a retainer angle 49 formed therein or provided thereon respectively. Preferably a urethane liner 50 is positioned in the grove 48. Such urethane liner 50 and retainer angle 49 facilitate sliding the blade bars 40 and 42 in these slots to obtain lateral movement of the shifting frame 10 on the stationary carrier frame. Such movement can be provided by conventional means and to this end a wedge block assembly 52 is usually slidably secured to each of the side bars 36 and 38 of the grid frame but only one such assembly is shown. Conventional means (not shown) operatively engage these wedge block assemblys 52 to shift the shifting frame laterally of the carrier frame when desired for the known purpose of dropping articles through the packing head, as described later on herein. The carrier frame 12 normally is mounted on the frame 14 of the case packer for limited, controlled longitudinal movement by roller means 21.

Grid Partition Plate Mount

FIG. 2 best shows how the grid plates 18 are positioned in the stationary or carrier frame and such grid partition plate is shown as positioning a plurality of dependent drop fingers 54 thereon in any known manner.

It is an important feature of the present invention that the mounting bar or plate 32 and the end bar 28 each operatively positions a grid clamp mounting plate 33 thereon as part of the grid clamp mounting means. The details of the grid clamp mounting plates 33 and of grid clamps or mounting brackets 60 are shown in FIGS. 2 and 4 and it is seen that the grid clamp mounting plates 33 are provided with positioning keyhole slots 62 to facilitate their attachment to or removal from the end bar 28 or carrier bar 32. A plurality of these grid clamps 60 are positioned on each grid clamp mounting plates 33 one of which is located at each end of the stationary frame assembly. The grid clamps 60 each have a slot 64 extending therein from their upper ends. The grid clamps 60 are so positioned that the slots 64 extend vertically and with pairs of the grid clamps being positioned on opposed relationship by the grid clamp mounting plates 33 on opposed faces of the mounting bars or plates 28 and 32. The grid clamps are conventionally secured to the grid clamp mounting plates 33. The grid partition plates 18 will slide down into the slots 64 and be mechanically secured therein. Yet another feature of the slots 64 is that a little projection 68 is provided at or adjacent the lower end of each of these slots and a bottom support flange or shelf 70 is formed in each grid clamp at the lower end of the slot 64 therein. The partition plates, as shown in FIG. 4, are thus sized so as to be supported on these shelves 70 at their lower corners and also an opening or recess 72 is formed in a lower edge surface of each partition plate so that the projection 68 can be received in this recess and prevent the partition plate from being knocked or moved upwardly in an undesirable manner at any time.

In order to remove or position one of the grid partition plates 18, it is necessary to move the carrier bar 32 longitudinally of the stationary frame 20 slightly so as to release the little projection 68 from the recess 72 in the edge of the partition plate. Thus in order to permit limited longitudinal movement of this bar 32 on which one of the grid clamp mounting plates 33 is positioned, a stop bolt 74 is secured to the stationary frame side bar 22 on the inner surface thereof. This stop bolt is shown in FIG. 1 and it will engage the wedge block 34 to limit its longitudinal movement. Should any grid of different longitudinal size be desired to be positioned on the stationary frame 12, obviously a plurality of holes could be provided for the stop bolt 74 so that the longitudinal length of the article group or pattern defined in the grid frame could be varied.

The shifting frame cross or blade bars 40 and 42 have yet a further function in the apparatus and FIG. 3 shows that some type of a contoured upper end such as a T-shape in verticle section upper end 76, is provided for the blade bars at the reduced height center portions thereof. Such T-shaped upper ends 76 are provided to mount split clamp means or mounting blocks 78 for the skid blades 20 and permit ready adjustment in position of such clamp means along the cross bars. Each clamp means 78 is preferably made from two clamp sections 80 and 82 each of which extends vertically of the shifting frame and with the clamp sections being provided with any desired alignment means thereon for inter-engaging action therebetween to obtain a good operative clamp. The clamp sections cooperate, as shown in FIG. 3, to provide a vertically extending slot 84 in the clamp means positioned at the upstream end of the apparatus whereas a similar slot 85 is formed in the clamp member provided at the downstream at the grid frame but with such downstream end slot being inclined downstream of the grid frame while the slot 84 is inclined slightly upstream of the apparatus. Hence when the clamp sections 80 and 82 are secured together in a suitable manner as by a bolt 86, the clamp members will be fixed in position on this T-shaped clamp rail or end 76. However, when desired, the bolts 86 can be loosened and the clamps can be slid transversely of their mounting rails when adjusting the packing head for handling different locations or numbers of the partition plate.

It will be seen that the clamp sections 80 and 82 at the opposite ends of the shifting frame are just reversed in position and this provides the opposite inclination of the slots 84 and 85. The skid blade 20 is positioned at its upstream end by a member such as a roll pin 88 or the like that engages the end of the skid blade 20 and is dropped down into the slot 84 to be retained therein operatively when operative tension is set upon the skid blade. The downstream end of the skid blade is mounted in a conventional manner and a coil spring 90 extending under compression between an end portion of the clamp means 78 and an end rivet or other end pin 92 operatively secured to the skid blade. Thus the skid blade can be released for repair or replacement by compressing the spring 90 by longitudinal forces on the skid blade and the upstream end of the skid blade can have its cross pin 88 moved upwardly of the slot 84 to release the skid blade and permit the downstream end of the blade to be likewise released. These skid blades are received in slots 81 in the clamp sections.

The shifting frame 10 has an article stop block 94 provided for each course of articles being processed and the articles will contact the stop block 94 to start to be grouped into case filling assemblies. The stop blocks 94 are suitably clamp mounted on a bar 95 that is slidably secured to the grid frame side bars 36 and 38 by wedge clamps 96 and 98. These stop blocks 94 receive repeated impacts from the articles being processed and, to avoid wear on the faces on the stop blocks 94, there is provided a cushion pad 100. This cushion pad 100 can be made from any suitable material, usually readily moldable polyurethane or synthetic rubber and the pad has stems 102 extending therefrom for engaging corresponding shaped holes 104 formed in the upstream face of the stop block. Hence the cushion pad 100 can be held in place by friction and can be repaired or replaced as desired. This stop block 94 is of any conventional construction and usually it has an article engaging flag 106 pivotally carried thereby to be moved downstream when a lead article flows down the packing head to contact this indicator or flag 106, all is done in a known manner in other article packer apparatus.

OPERATION

When one has a packing head operatively assembled and it is desired to change the size of the article being processed or the type or grouping of articles to be deposited into carrier cases, all that is necessary to do in the apparatus of the invention is to loosen the wedge blocks 34 that hold the cross bar 32 in position and slide such cross bar and associated means longitudinally downstream of the stationary frame until the bar contacts the stop bolt 74. At such time the grid partition plates 18 are readily removeable from the opposed pairs of the grid clamps 60 with which they are engaged and such grid partition plates with the associated drop fingers then can be lifted up and out of the grid frame. Before such removal of the grid partition plates, it normally is necessary to also release the clamps or wedges 96 and 98 that secure the stop block mounting bar 95 to the side rails 36 and 38 and slide such cross bar 95 longitudinally a short distance to insure clearance for the grid partition plate in removing the same from the apparatus.

Then at any desired time the bolt means 86 holding the skid blade clamp means 78 in position can be loosened and the clamp means can be moved laterally on the skid blade bars to obtain the required different lateral spacing of the rows of articles to be processed. Then a new set of grid partition plates with associated drop fingers are provided for the stationary frame and are moved into engagement with the grid clamps provided on a new set of grid clamp mounting plates 33. This new set of grid clamp mounting plates is provided with the grid clamps 60 in desired lateral relationships to each other and to the rest of the packing head so that the positions then provided for the grid partition plates 18 will be such as to provide the articles to be processed in the number and width of rows as required. Then the cross bar 32 would be moved to lock the grid partition plates in operative positions and the wedge blocks 34 would be secured into position and the stationary frame would be ready for operation under the new desired operating conditions. Also the cross bar 95 for stop blocks 94 would be positioned at the end of the path of movement of each stream of articles being processed as determined by the position and spacing of the grid partition plates.

Hence, in order to change the grouping of the articles being processed for case packing action, all one needs is an extra set of the partition plates 18 with associated drop fingers thereon. Then these plates together with the proper pair of the grid clamps mounting bars or plates 33, 33 for the new pattern for articles to be processed and grouped would be mounted in the stationary frame and the stationary frame would be ready to function on a revised basis.

The grid clamps 60 can be metal or other castings to obtain low cost, identical members to use for positioning partition plates in the stationary frame 12. Such clamps 60 are secured to the flat, inexpensive grid clamp mounting plates 33 that are in turn readily removably secured to the grid clamp mounting bars 28 and 32 to form the grid clamp mounting means as one form of readily removable mounts for grid partition plates but any portion of such means can be combined with another part of the device to reduce the number of parts if it is desired to form the mounting plates 33 and grid clamps 60 thereon as a unit.

It is submitted that the apparatus of the invention has made the packing head much more flexible in the number and types of article groups that a packing head apparatus can process and wherein only minimal inventories of extra parts would be required to change the packing head from one article grouping pattern to another. Entire packing head assemblies would not be required to change the type of article and article grouping action and patterns being processed at any given time. Thus it is believed that the objects of the invention have been achieved.

When one complete embodiment of the invention has been disclosed herein, it will be appreciated that modification of this particular embodiment of the invention may be resorted to without departing from the scope of the invention.

What is claimed is:

1. In a packing head for a case packer apparatus or the like including a carrier frame, a shifting frame operably positioned on said carrier frame for movement laterally thereof and including side bars and blade bars, said carrier frame being stationary in relation to said shifting frame, a plurality of mounting blocks slidably carried by each of said blade bars, means for securing said mounting blocks to said blade bars in fixed positions thereon, said mounting blocks normally being positioned in opposed pairs at upstream and downstream ends of said shifting frame, and longitudinally extending skid blades positioned on and extending between said pairs of mounting blocks whereby lateral movement of said skid blades as a unit will occur with movement of said shifting frame but where the lateral relation of the said skid blades to said stationary carrier frame can be varied.

2. In a packing head as in claim 1 wherein said mounting blocks are mechanically interlocked with said blade bars, said mounting blocks having slots in their upper surfaces for receiving skid blades, and said mounting blocks being made from two laterally extending pieces secured together to define a laterally extending slot for receiving a skid blade positioning device in at least the upstream one of said mounting blocks.

3. In a packing head for a case packer apparatus or the like including a stationary frame, a shifting frame operably positioned on said stationary frame for movement laterally thereof, and a plurality of grid partition plates, said stationary frame including a pair of mounting bars extending across it adjacent opposite ends thereof, and a plurality of grid clamps operatively positioned on opposed surfaces of said mounting bars, said grid clamps having vertically extending slots in their upper end portions, said grid clamps being positioned in opposed pairs adjacent opposite ends of said stationary frame, each of said grid partition plates slidably engaging the said slots in an opposed pair of said grip clamps to be positioned thereby.

4. In a packing head for a case packer as in claim 3 where said grid clamps are positioned on plates removably secured to said mounting bars.

5. In a packing head for a case packer as in claims 3 or 4, where said grid clamps each have a projection formed in said slots and said partition plates have an edge slot therein engageable with said projection to prevent upward movement of said partition plates, said grid clamps also having a support shelf thereon to engage and aid in positioning said partition plates.

6. In a packing head for a case packer as in claim 3 where a skid blade for each partition plate is provided on said shifting frame and clamp means secure said skid blades to said shifting frame but provide for lateral adjustment of said skid blades.

7. In a packing head for a case packer as in claim 5 where clamp means slidably secure a said mounting bar to said carrier frame to provide longitudinal movement of a said mounting bar for release or engagement of said grid partition plates.

8. In a packing head for a case packer apparatus or the like as in claim 3 where said stationary frame has a downstream end cross bar with a transversely extending slot in its upper surface, said shifting frame has a downstream cross bar that slidably engages said slot to facilitate sliding said shifting frame laterally on said stationary frame.

9. In a packing head for a case packer apparatus or the like including a stationary frame, a shifting frame operably positioned on said carrier frame for movement laterally thereof and including side bars and end blade bars, a plurality of mounting blocks slidably engaging each of said blade bars and being mechanically interlocked therewith, means for securing said mounting blocks to said blade bars in fixed positions thereon, said mounting blocks having longitudinally directed slots in their upper surfaces, said mounting blocks normally being positioned in opposed pairs at upstream and downstream ends of said shifting frame, a skid blade positioned in said slots of and extending between each of said pairs of mounting blocks whereby lateral movement of said skid blades as a unit occurs with movement of the shifting frame, a plurality of grid partition plates, a pair of grid clamp mounting bars on and extending across said stationary frame adjacent opposite ends thereof, and a plurality of grid clamps operatively secured to opposed surfaces of said grid clamp mounting bars, said grid clamps having vertically extending slots in their upper end portions, said grid clamps being positioned in opposed pairs adjacent opposite ends of said stationary frame, each of said grid partition plates slidably engaging said slots in an opposed pair of said grid clamps to be positioned thereby.

* * * * *

UNITED STATES PATENT OFFICE
CERTIFICATE OF CORRECTION

Patent No. 4,512,134 Dated April 23, 1985

Inventor(s) Mary K. Robinson and Timothy F. Probst

It is certified that error appears in the above-identified patent and that said Letters Patent are hereby corrected as shown below:

On the Title Pate, Item /73/ should read:

[73] Assignee: Figgie International, Inc., Willoughby, Ohio

Signed and Sealed this

Twenty-fourth Day of March, 1987

*Attest:*

DONALD J. QUIGG

*Attesting Officer* *Commissioner of Patents and Trademarks*